United States Patent [19]

Oeschger

[11] 4,079,217

[45] Mar. 14, 1978

[54] VACUUM INTERRUPTER WITH BELLOWS DAMPENER

[75] Inventor: Joseph Emil Oeschger, Palo Alto, Calif.

[73] Assignee: International Telephone and Telegraph Corporation, New York, N.Y.

[21] Appl. No.: 708,745

[22] Filed: Jul. 26, 1976

[51] Int. Cl.[2] ..... H01H 33/66

[52] U.S. Cl. ..... 200/144 B

[58] Field of Search ..... 200/144 B

[56] References Cited

U.S. PATENT DOCUMENTS

| | | | |
|---|---|---|---|
| 3,539,747 | 11/1970 | Robinson | 200/144 B |
| 3,555,222 | 1/1971 | Camacho | 200/144 B |

FOREIGN PATENT DOCUMENTS

| | | | |
|---|---|---|---|
| 1,182,782 | 3/1970 | United Kingdom | 200/144 B |

*Primary Examiner*—Robert S. Macon

*Attorney, Agent, or Firm*—William T. O'Neil

[57] ABSTRACT

Apparatus for improving the life of metallic bellows used in a hermetically sealed device having a movable element therein such as, vacuum relays and circuit breakers. The convolutions of the metal bellows are filled by a silicone dielectric gel for an axial length including several such convolutions adjacent to the movable end of the bellows, thereby to damp axial mechanical vibrations and prevent excessive stress build-up in the bellows portions adjacent to the moveable end.

6 Claims, 1 Drawing Figure

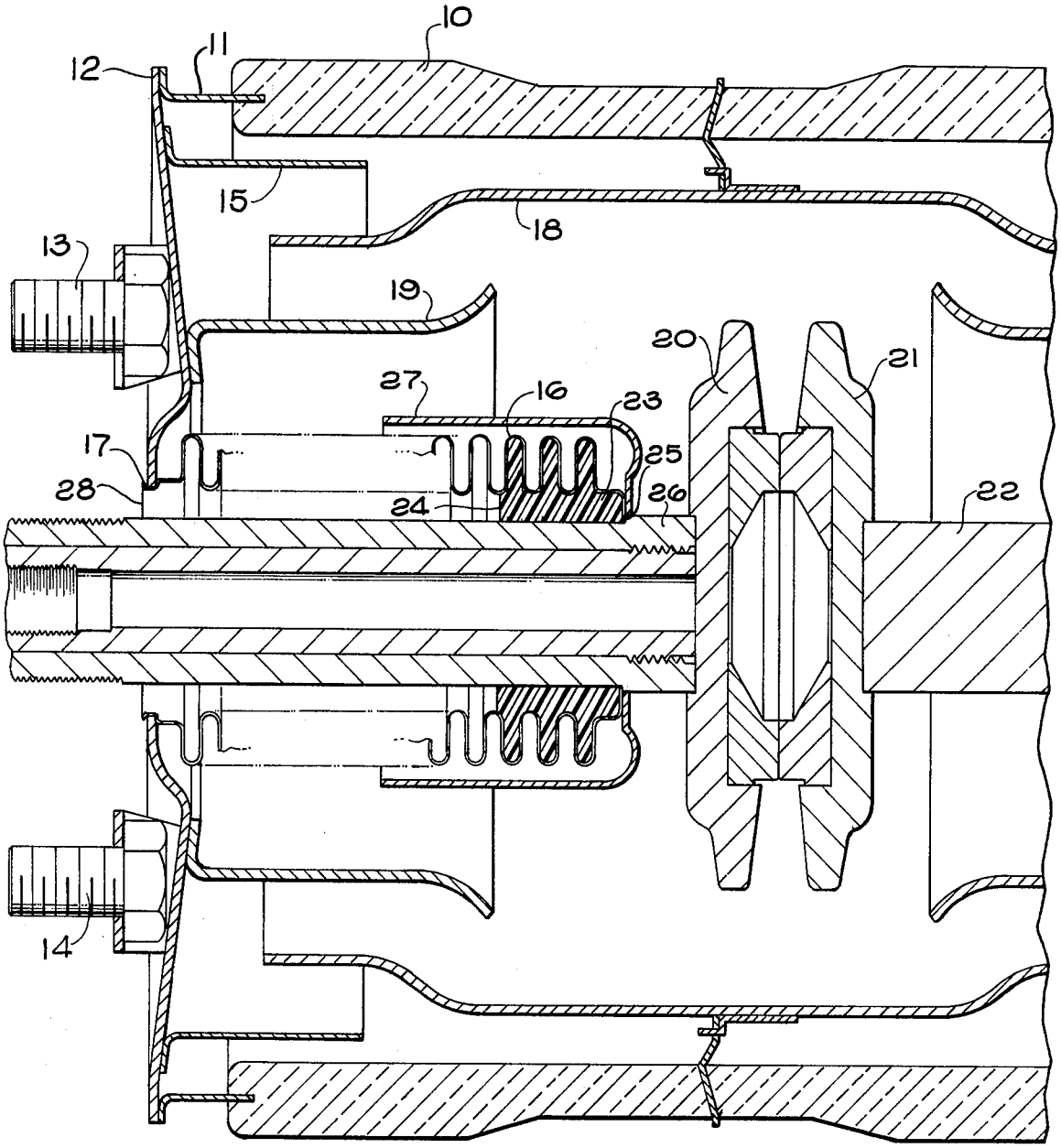
10
11
12
15
18
13
19
20
21
27
16
23
17
25
28
24
26
22
14

VACUUM INTERRUPTER WITH BELLOWS DAMPENER

BACKGROUND OF THE INVENTION

1. Field of the Invention

The invention relates generally to hermetically sealed devices employing compressible and extendable bellows members for transferring the motion of an external control member to an internal movable member, and most particularly to vacuum and other hermetically sealed interrupters.

2. Description of the Prior Art

In the prior art extensive use has been made of axially extendable and compressible metallic bellows members, wherever the transfer of motion through the enclosure of a hermetically sealed device is required. That type of device broadly embraces the fields of vacuum and gas-filled capacitors and circuit breakers, those devices having long been employed in high voltage, high power applications because of the relatively favorable voltage breakdown characteristics afforded as compared to the same devices with air dielectric.

The invention is most particularly related to vacuum enclosure devices of the aforementioned general character, which encounter high acceleration, axial control movements such as vacuum breakers or interrupters as they are frequently called. In a vacuum interrupter, separation of the contacts is effected relatively violently in order that the delay in interrupting an over-current fault situation is minimized. Depending upon design and the nature of the controlling equipment, the closing action of a vacuum interrupted also might be accomplished in high velocity, high acceleration motion.

Since the bellows and related moving parts comprise a mass-compliance mechanical system, a typical series of masses connected by intervening springs may be thought of as schmatically representing the mechanical dynamics of the situation. The series of masses and intervening springs representing the bellows is anchored at one end corresponding to the fixed end of the bellows. When the movable end of such a system is rapidly accelerated in either direction, the forces operating on the masses must be transmitted through the springs. The usual metal bellows has an equivalent spring rate introduced by the resilience of the metal used, the latter being formed into a series of axially stacked convolutions. In such arrangements, the relatively large mass of the bellows system in relation to the spring rate of the individual convolutions result in excessive bellows convolution stress at and near the movable end of the arrangement. The input convolutions (i.e., those closest to the movable bellows end) are unable to accelerate the masses distributed down the bellows axial length without excessively distorting. It has not been uncommon for the first convolution to fail after only a few hundred cycles of operation.

Typical of the prior art in vacuum interrupters are U.S. Pat. Nos. 3,190,991; 3,231,704; 3,368,023; 3,555,222; and 3,627,963. That variety of prior art shows many of the variations of glass and ceramic enclosures, shield assemblies, etc. The present invention is applicable to any one of those prior art devices.

The manner in which the present invention provides an improved structure to greatly ameliorate the aforementioned problem in connection with devices such as vacuum and gas-filled interrupters will be understood as this description proceeds.

SUMMARY

In the bellows of a vacuum interrupter or similar device, the structure in accordance with the present invention includes the introduction of a resilient semi-solid damper material which in mass compliance system terms, represents an energy absorbing (shock absorber) material in parallel with the first few, (or any arbitrary number) convolutions (springs) of the mass/spring system. The term semi-solid embraces the rubber-like materials generally and particularly the characteristics of silicone gels in that respect. Thus, the transient spring rate of the bellows convolutions is substantially increased without significantly adversely affecting the steady state of the bellows system. The result is a very substantial reduction in bellows convolution distortion near the movable bellows end and therefore the relatively high stress levels encountered at that portion of the axial bellows during axial accelerations are greatly reduced. Moreover, the standing waves due to axial vibrations caused by the shock of operation are greatly reduced by the damping effect.

In actual practice, a material such as a silicone gel is permanently installed within the folds of the convolutions of the bellows, this providing damping (shock absorbing) functioning in parallel with the individual convolution springs where the gel has been introduced. This expedient has been found to be greatly superior to such standard ways of achieving mechanical damping as the use of a viscous damping oil. Such an oil or other liquid is difficult to contain and ordinarily requires vertical orientation of the bellows, a situation which may be inconvenient in a vacuum interrupter installation and impossible to achieve in shipment. Still further, damping oils are difficult to obtain with high viscosity, reasonably low viscosity index with temperature, low pour point and long oxidation-stability life. Over an operating temperature range of −55° C to 100° C such characteristics are difficult to achieve and maintain, particularly in view of the fact that the oil is subjected to aggitation and frothing during interrupter operation.

The silicone dielectric gel overcomes all of the aforementioned problems in that, once emplaced, the gel stays in place through temperature extremes of −60° C to +150° C, does not creep, splash or froth during operation, and is subject to easy viscosity or stiffness control. Still further the viscosity or stiffness of the material changes but little over a wide temperature range and as a silicone compound, it represents the inherently low aging and oxidizing characteristics typical of those materials.

The details of a vacuum interrupter structure which constitutes a typical employment of the concepts of the present invention, will be described hereinafter.

BRIEF DESCRIPTION OF THE DRAWING

A single FIGURE drawing is presented showing an axially-sectioned view of a typical vacuum interrupter employing the bellows damping structure according to the invention.

DESCRIPTION OF A PREFERRED EMBODIMENT

Referring now to the figure, the axially sectioned portion of a more-or-less typical vacuum breaker or interrupter structure illustrates those portions of the interrupter necessary to understand the nature and function of the invention.

The figure illustrates a generally cylindrical enclosure 10, assumed to be glass, although, it will be understood that a known type of ceramic enclosure may also be used. The enclosure per se, is not directly related to the invention, although it is a part of a complete structure employing the invention.

Sealed into the left end (as illustrated on the figure) of 10 are typical members 11 and end plate 12 with conductively associated studs 13 and 14. The member 12, and therefore studs 13 and 14, are conductively associated with the bellows 16 by furnace brazing or heliarc welding, such as at seal 17. The enclosure sealing is entirely typical of the metal-to-metal seals and metal-to-glass (or ceramic) sealing well known in the art. A completely hermetically-sealed structure is obtained, which may be evacuated or gas-filled.

Due to the problem of contact material spattering during circuit break, a vacuum interrupter commonly incorporates shields such as 15, 18 and 19 to prevent the deposition of spattered contact material on the inside of the insulating housing 10 or on the bellows 16.

A pair of electrical contacts 20 and 21 are shown engaged. A connection (not shown) to the conductive support rod 22 for contact 21 would provide for one pole of the interrupter externally. Connection to the other pole of the interrupter is provided through the studs 13 and 14, the current path to and from contact 20 being at least partially through the bellows.

Since 20 is the moving contact of the assembly, contact 20 and the conductive sleeve 26 attached thereto are moved sharply to the left to effect circuit break. The actuating mechanism which produces this motion is not a part of the present invention, but it will be understood that such mechanism is supplied externally, for that purpose.

The bellows and additional bellows shield 27 are hermetically brazed to the conductive tubular member 26 essentially at point 25.

During the sharply accelerated contact opening, as hereinbefore indicated, those convolutions of the bellows closest to point 25 are accelerated very rapidly, the bellows convolutions farther to the left receiving less acceleration-induced stress because of the individual convolution masses between the right and left ends of the bellows, as follows from the spring-mass system analysis aforementioned. One particular form of damping according to the present invention is shown at 23 where the resilient, semi-solid damping material is a silicone dielectric gel such as Dow Corning F-13-523 mixed in the standard 10–1 ratio has been poured into three of the convolutions while the assembly was placed in a vertical position with studs 13 and 14 oriented upward. This silicone material 23 is cured in place and thereafter remains essentially as shown. As the contact 20 moves to the left, the convolutions of the bellows 16 tend to be flattened somewhat in the axial direction and a certain amount of the silicone material 23 therefore must "flow" and expand to the left between the inside of the bellows and 26, by expansion at 24.

It will be realized that the inside surface of the bellows 16 is open to atmosphere, whereas within the enclosure 10, and therefore against the outside perimeter of the bellows, the evacuated (or gas-filled) volume is extant. In this way, outgassing of the silicone material, which would occur if it were within the evacuated space, is not a problem.

It will be realized, that a number of variations on the shape and emplacement of the silicone material are possible. The fact that the silicone material selected for the illustration is a dielectric gel is of no consequence per se, since its function is entirely mechanical. Quite obviously, other silicone materials or similar gels might also be used in the device. The selection is basically one made in consideration of environmental requirements.

In the implantation of the gel 23, it would quite obviously be possible to insert a removable sleeve of non-wettable material, such as teflon, for example, over 26 in the area of the gel so that an annular clearance-space would be formed between 23 and 26. Still further, the actual length of the convolution area bearing the silicone material can obviously be extended over virtually the full length of the bellows. In that event however, it becomes more important to provide bulk expansion space for the damping material either as a nominal clearance between 23 and 26, or in some other way.

It is possible, although relatively uneconomical from a process point of view, to insert the silicone material into the bellows, again through the annular opening at 28 while subjecting the entire device to rotation with the member 26 oriented vertically (studs 13 and 14 up). This would have a centrifuge effect so that the implantation of the silicone could be limited to the actual convolutions themselves leaving a larger clearance between the inside of the bellows and the member 26 outside perimeter.

Other modifications and variations will suggest themselves to those skilled in this art once the principles of this invention are fully understood. It is noted that there is a synergistic effect produced in that the characteristics of the silicone gel provide unique cooperation with the bellows to produce damping within a predetermined number of the bellows convolutions from the movable end thereof.

It is not intended that the scope of the invention should be considered limited to the drawing of this description, these being intended to be typical and illustrative only.

What is claimed is

1. In a device having a movable element hermetically sealed within an enclosure and including an axially operating bellows for permitting thrust motion to be imported to said movable element by means of a control member external to said enclosure, the combination comprising:

means joining said bellows to said enclosure to provide a fixed bellows end;

means joining said control member to said movable element through the sealed movable end of said bellows;

and bellows damping means comprising a semi-solid resilient material emplaced within a predetermined number less than all of the convolutions of said bellows extending from said movable end.

2. Apparatus according to claim 1 in which said semi-solid resilient material is defined as a silicone gel.

3. Apparatus according to claim 2 in which said silicone gel is further defined as a dielectric type silicone gel.

4. Apparatus according to claim 1 in which said device is defined as a hermetically sealed interrupter including a pair of electrical contacts, said movable element being one of said contacts, said means joining said control member to said movable element being the movable end of said bellows with associated seals, said bellows movable end thereby being subject to substantially the same accelerations as said movable member during operation of said device, and in which said resilient material operates to increase the effective spring constant of the bellows convolutions into which it is emplaced.

5. Apparatus according to claim 4 in which resilient material is defined as a silicone gel.

6. Apparatus according to claim 5 in which said silicone gel is further defined as a dielectric type silicone gel.

* * * * *